US006535811B1

(12) United States Patent
Rowland et al.

(10) Patent No.: US 6,535,811 B1
(45) Date of Patent: Mar. 18, 2003

(54) SYSTEM AND METHOD FOR REAL-TIME ELECTRONIC ENGINE CONTROL

(75) Inventors: Zach L. Rowland, Bowling Green, KY (US); Jimmy D. Claiborne, Scottsville, KY (US); David Edward Heath, Bowling Green, KY (US); John D. Meaney, Hartland, MI (US)

(73) Assignee: Holley Performance Products, Inc., Bowling Green, KY (US)

( * ) Notice: Subject to any disclaimer, the term of this patent is extended or adjusted under 35 U.S.C. 154(b) by 91 days.

(21) Appl. No.: 09/699,407

(22) Filed: Oct. 31, 2000

Related U.S. Application Data

(60) Provisional application No. 60/163,253, filed on Nov. 3, 1999.

(51) Int. Cl.[7] ..... F02D 45/00
(52) U.S. Cl. ..... 701/115
(58) Field of Search ..... 701/115

(56) References Cited

U.S. PATENT DOCUMENTS

| | | | | |
|---|---|---|---|---|
| 4,182,278 A | | 1/1980 | Coakwell | 123/1 A |
| 4,331,121 A | | 5/1982 | Stokes | 123/575 |
| 4,467,764 A | | 8/1984 | Takasu et al. | 123/416 |
| 4,480,595 A | | 11/1984 | Hobby et al. | 123/1 A |
| 4,494,488 A | | 1/1985 | Wheatley | 123/1 A |
| 4,503,823 A | | 3/1985 | Shibukawa et al. | 123/406.66 |
| 4,572,140 A | | 2/1986 | Wheatley | 123/541 |
| 4,683,843 A | | 8/1987 | Norcia et al. | 123/1 A |
| 4,750,453 A | | 6/1988 | Valdespino | 123/1 A |
| 4,798,190 A | | 1/1989 | Vaznaian et al. | 123/531 |
| 4,827,888 A | | 5/1989 | Vaznaian et al. | 123/531 |
| 4,840,157 A | | 6/1989 | Furrow | 123/352 |
| 4,960,080 A | | 10/1990 | O'Neill et al. | 123/254 |
| 5,088,464 A | | 2/1992 | Meaney | 123/478 |
| 5,091,858 A | | 2/1992 | Paielli | 701/115 |
| 5,174,263 A | | 12/1992 | Meaney | 123/478 |
| 5,287,281 A | | 2/1994 | Meaney | 701/105 |
| 5,341,785 A | | 8/1994 | Meaney | 123/452 |
| 5,444,628 A | | 8/1995 | Meaney et al. | 701/109 |
| 5,699,776 A | | 12/1997 | Wood et al. | 123/531 |
| 6,009,372 A | * | 12/1999 | Baker et al. | 701/115 |

* cited by examiner

*Primary Examiner*—Andrew M. Dolinar
(74) *Attorney, Agent, or Firm*—Hunton & Williams

(57) ABSTRACT

A method and system for controlling an engine is disclosed. The method and system accomplish engine control based on one or more defined relationships. The present invention permits a user to adjust the defined relationships that are used to control the engine. Those adjustments are rewritten to the controller in real-time without interrupting the control operation.

11 Claims, 13 Drawing Sheets

| MAP | 500 | 1000 | 1500 | 2000 | 2500 | 3000 | 3500 | 4000 | 4500 | 5000 | 5500 | 6000 | 6500 | 7000 | 7500 | 8000 |
|---|---|---|---|---|---|---|---|---|---|---|---|---|---|---|---|---|
| 240 | 10 | 18 | 25 | 32 | 40 | 48 | 55 | 62 | 70 | 78 | 85 | 92 | 100 | 108 | 115 | 122 |
| 224 | 10 | 17 | 24 | 31 | 38 | 45 | 52 | 59 | 66 | 73 | 80 | 87 | 94 | 101 | 108 | 115 |
| 208 | 10 | 16 | 23 | 30 | 36 | 42 | 49 | 56 | 62 | 68 | 75 | 82 | 88 | 94 | 101 | 108 |
| 192 | 10 | 16 | 22 | 28 | 34 | 40 | 46 | 52 | 58 | 64 | 70 | 76 | 82 | 88 | 94 | 100 |
| 176 | 10 | 16 | 21 | 26 | 32 | 38 | 43 | 48 | 54 | 60 | 65 | 70 | 76 | 82 | 87 | 92 |
| 160 | 10 | 15 | 20 | 25 | 30 | 35 | 40 | 45 | 50 | 55 | 60 | 65 | 70 | 75 | 80 | 85 |
| 144 | 10 | 14 | 19 | 24 | 28 | 32 | 37 | 42 | 46 | 50 | 55 | 60 | 64 | 68 | 73 | 78 |
| 128 | 10 | 14 | 18 | 22 | 26 | 30 | 34 | 38 | 42 | 46 | 50 | 54 | 58 | 62 | 66 | 70 |
| 112 | 10 | 14 | 17 | 20 | 24 | 28 | 31 | 34 | 38 | 42 | 45 | 48 | 52 | 56 | 59 | 62 |
| 96 | 10 | 13 | 16 | 19 | 22 | 25 | 28 | 31 | 34 | 37 | 40 | 43 | 46 | 49 | 52 | 55 |
| 80 | 10 | 12 | 15 | 18 | 20 | 22 | 25 | 28 | 30 | 32 | 35 | 38 | 40 | 42 | 45 | 48 |
| 64 | 10 | 12 | 14 | 16 | 18 | 20 | 22 | 24 | 26 | 28 | 30 | 32 | 34 | 36 | 38 | 40 |
| 48 | 10 | 12 | 13 | 14 | 16 | 18 | 19 | 20 | 22 | 24 | 25 | 26 | 28 | 30 | 31 | 32 |
| 32 | 10 | 11 | 12 | 13 | 14 | 15 | 16 | 17 | 18 | 19 | 20 | 21 | 22 | 23 | 24 | 25 |
| 16 | 10 | 10 | 11 | 12 | 12 | 12 | 13 | 14 | 14 | 14 | 15 | 16 | 16 | 16 | 17 | 18 |
| 0 | 10 | 10 | 10 | 10 | 10 | 10 | 10 | 10 | 10 | 10 | 10 | 10 | 10 | 10 | 10 | 10 |

Spark Table

Spark

| MAP | 500 | 1000 | 1500 | 2000 | 2500 | 3000 | 3500 | 4000 | 4500 | 5000 | 5500 | 6000 | 6500 | 7000 | 7500 | 8000 |
|---|---|---|---|---|---|---|---|---|---|---|---|---|---|---|---|---|
| 240 | 40 | 40 | 40 | 40 | 40 | 40 | 40 | 40 | 40 | 40 | 40 | 40 | 40 | 40 | 40 | 40 |
| 224 | 40 | 40 | 40 | 40 | 40 | 40 | 40 | 40 | 40 | 40 | 40 | 40 | 40 | 40 | 40 | 40 |
| 208 | 40 | 40 | 40 | 40 | 40 | 40 | 40 | 40 | 40 | 40 | 40 | 40 | 40 | 40 | 40 | 40 |
| 192 | 40 | 40 | 40 | 40 | 40 | 40 | 40 | 40 | 40 | 40 | 40 | 40 | 40 | 40 | 40 | 40 |
| 176 | 40 | 40 | 40 | 40 | 40 | 40 | 40 | 40 | 40 | 40 | 40 | 40 | 40 | 40 | 40 | 40 |
| 160 | 12 | 14 | 17 | 20 | 22 | 24 | 27 | 30 | 32 | 34 | 37 | 40 | 40 | 40 | 40 | 40 |
| 144 | 12 | 14 | 16 | 19 | 21 | 23 | 26 | 28 | 30 | 32 | 34 | 40 | 40 | 40 | 40 | 40 |
| 128 | 12 | 14 | 16 | 18 | 20 | 22 | 24 | 26 | 28 | 30 | 32 | 40 | 40 | 40 | 40 | 40 |
| 112 | 12 | 14 | 16 | 17 | 19 | 21 | 22 | 24 | 26 | 28 | 30 | 40 | 40 | 40 | 40 | 40 |
| 96 | 12 | 14 | 15 | 16 | 18 | 20 | 21 | 22 | 24 | 26 | 27 | 40 | 40 | 40 | 40 | 40 |
| 80 | 12 | 13 | 14 | 16 | 17 | 18 | 20 | 21 | 22 | 23 | 24 | 40 | 40 | 40 | 40 | 40 |
| 64 | 12 | 13 | 14 | 15 | 16 | 17 | 18 | 19 | 20 | 21 | 22 | 40 | 40 | 40 | 40 | 40 |
| 48 | 12 | 13 | 14 | 14 | 15 | 16 | 16 | 17 | 18 | 19 | 20 | 40 | 40 | 40 | 40 | 40 |
| 32 | 12 | 12 | 13 | 14 | 14 | 14 | 15 | 16 | 16 | 16 | 17 | 40 | 40 | 40 | 40 | 40 |
| 16 | 12 | 12 | 12 | 13 | 13 | 13 | 14 | 14 | 14 | 14 | 14 | 40 | 40 | 40 | 40 | 40 |
| 0 | 12 | 12 | 12 | 12 | 12 | 12 | 12 | 12 | 12 | 12 | 12 | 40 | 40 | 40 | 40 | 40 |

IAC - Idle Air Control

Derivative term 0 Proportional term 0 Integral Term 0

| | | | | | | | | | | | | | | | | |
|---|---|---|---|---|---|---|---|---|---|---|---|---|---|---|---|---|
| Idle RPM vs. Coolant | 0 | 0 | 0 | 0 | 0 | 0 | 0 | 0 | 0 | 0 | 0 | 0 | 0 | 0 | 0 | 0 |
| IAC Parked Position vs. Coolant | 0 | 0 | 0 | 0 | 0 | 0 | 0 | 0 | 0 | 0 | 0 | 0 | 0 | 0 | 0 | 0 |
| Throttle Follower vs. TPS | 0 | 0 | 0 | 0 | 0 | 0 | 0 | 0 | 0 | 0 | 0 | 0 | 0 | 0 | 0 | 0 |

FIG. 10

O2 - Closed Loop Parameters

Closed Loop Proportional Gain term

| | | | | | | | |
|---|---|---|---|---|---|---|---|
| 0 | 0 | 0 | 0 | 0 | 0 | 0 | 0 |
| 0 | 0 | 0 | 0 | 0 | 0 | 0 | 0 |
| 0 | 0 | 0 | 0 | 0 | 0 | 0 | 0 |
| 0 | 0 | 0 | 0 | 0 | 0 | 0 | 0 |
| 0 | 0 | 0 | 0 | 0 | 0 | 0 | 0 |
| 0 | 0 | 0 | 0 | 0 | 0 | 0 | 0 |
| 0 | 0 | 0 | 0 | 0 | 0 | 0 | 0 |
| 0 | 0 | 0 | 0 | 0 | 0 | 0 | 0 |

Closed Loop Integral term

| | | | | | | |
|---|---|---|---|---|---|---|
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |

Minimum engine temp to go closed loop 180

Cold start delay before going closed loop 60

Hot start delay before going Closed Loop 10

Below this RPM goes open loop 900

Below this TPS closed loop 200

FIG. 12

SYSTEM AND METHOD FOR REAL-TIME ELECTRONIC ENGINE CONTROL

CROSS REFERENCE TO RELATED APPLICATIONS

This application is based on provisional application Ser. No. 60/163,253, titled "System and Method for Real-Time Electronic Engine Control," filed Nov. 3, 1999.

FIELD OF THE INVENTION

The present invention is directed to electronic control of engines. More specifically, the present invention is directed to a system and method for electronically controlling an engine including the ability to reprogram control variables without interrupting control operation.

BACKGROUND OF THE INVENTION

Electronic control of engines for automotive and related applications is known. Most control schemes involve calculation of controllable variables in real time based upon prestored relationships and inputs from sensors that monitor engine operation. Most control schemes enable control variables to be calculated in both open-loop operation during engine warm-up when engine fluid temperatures necessitate a richer air/fuel ratio, and in closed-loop operation under normal operating conditions when feedback from an oxygen sensor in the engine exhaust is used to monitor the air/fuel ratio. These control schemes typically require time to calculate the control variables.

To reduce calculation time, look-up tables are used to obtain control parameters during engine operation. Initially, it was proposed to employ look-up tables in open-loop control during engine warm-up. A serious problem and limitation of such systems lies in the requirement that the tables be permanently stored in a programmable read-only memory or PROM that is initially programmed at the factory, and that requires removal and replacement to change or reprogram any of the stored control variables. Although such requirement for removal and replacement at a factory service facility or the like has been considered to be acceptable for normal passenger car and light truck applications in view of EPA requirements that critical engine control parameters not be variable outside of an authorized service environment, such schemes are unacceptable for racing and other off-road applications, and in development and test environments. In applications of these types, it is necessary that the control variables be readily, individually and selectively reprograrnnable by a technician or other operator at the site.

An engine control system that utilizes look-up tables stored in an EEPROM during both wann-up and normal operation was developed. An external programming unit enabled system memory to be reprogrammed without requiring removal of the memory package, to accommodate specific vehicle conditions, such as fuel quality, climate, etc. Nevertheless, control variables could not be adjusted during actual engine operation.

Subsequent developments have enabled control variables to be adjusted during engine operation. Nevertheless, those adjustments do not immediately take effect and control does not take place when adjustments are being made. Rather, when a user is making adjustments to a particular control variable, the control relationship using the particular control variable is temporarily disabled. This leads to loss of responsiveness in the control process and to a potential dangerous situation.

SUMMARY OF THE INVENTION

It is an object of the present invention to overcome these and other drawbacks with conventional engine control systems.

It is another object of the present invention to provide a system and method for electronic control of engine operation that enables real-time reprogrammability of engine control relationships without disabling control functionality.

It is another object of the present invention to provide a system and method for electronic control of engine operation that enables reprogramming of engine control relationships and the control algorithm.

Another object of the invention is to provide a method and system for electronic engine control in which the engine control variables may be readily and selectively varied in real time without disabling control functionality, so that the operator may readily observe the effects of parameter variation and make any desired further adjustments without necessitating removal of table memory or other electronic circuitry.

Another object of the present invention is to provide a system and method for electronic engine control in which control variable tables are displayed to an operator to facilitate selective variation of the control relationships.

According to one embodiment, an engine control system for providing electronic control signals to an engine is disclosed. The system comprises one or more sensors that produce input signals in response to engine operating conditions and one or more control apparatus, responsive to the electronic control signals, that control engine operating conditions. An electronic control unit produces the electronic control signals in response to the input signals based on a set of defined relationships and a-user controller enables viewing and modifying of the set of defined relationships. The electronic control unit comprises a unique memory structure that enables selective rewriting of the set of defined relationships in real-time without interrupting control operation by the user controller.

According to another embodiment, a method of controlling an engine is disclosed. The method comprises providing one or more input signals in response to engine operating conditions and producing electronic control signals in response to the input signals based on a set of defined relationships. The electronic control signals are used by one or more control apparatus that control engine operating conditions. The defined relationships may be selectively modified in real-time without interrupting the production of electronic control signals.

Other features and advantages of the present invention will be apparent to one of ordinary skill in the art upon reviewing the detailed description of the present invention.

BRIEF DESCRIPTION OF THE DRAWINGS

FIG. 10 shows an exemplary graphical user interface used to display and adjust the idle air control relationship.

FIG. 12 shows an exemplary graphical user interface used to display and adjust various closed loop parameters.

DETAILED DESCRIPTION OF THE PREFERRED EMBODIMENTS

A method and system for controlling an engine is disclosed. According to one embodiment, the present invention advantageously permits a user to modify the defined relationships that are used to control the engine. Significantly, the method and system of the present invention enable those control relationships to be adjusted on-the-fly without interrupting the control operation in contrast to conventional engine control units.

Figure 1:
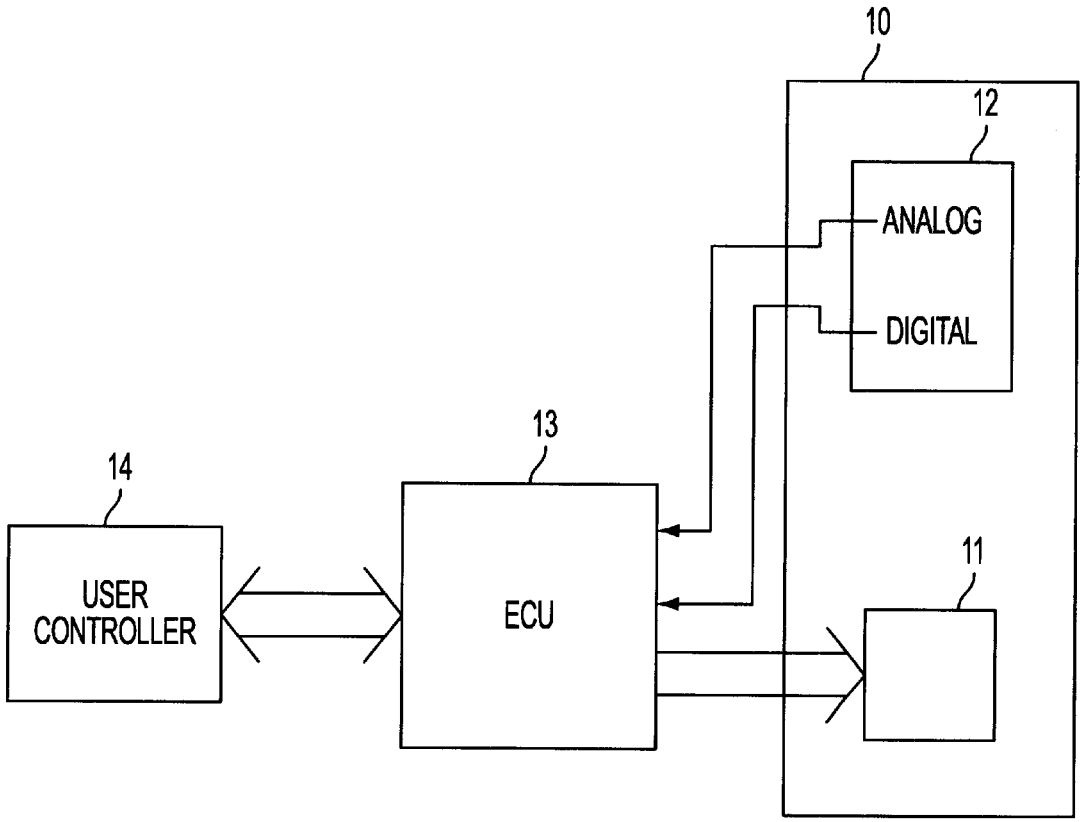
FIG. 1 is a schematic block diagram of an electronic engine control system according to one embodiment of the present invention.

FIG. 1 illustrates an engine control system in accordance with one embodiment of the invention. The engine control system of FIG. 1 comprises an internal combustion engine 10, an engine control unit 13 and a user controller 14. Internal combustion engine 10 comprises a number of control mechanisms 11 that are responsive to control signals developed by engine control unit (ECU) 13, and a number of sensors 12 that develop analog and digital signals for use by ECU 13.

ECU 13 is shown and will be explained in more detail in conjunction with FIG. 2. Briefly, ECU 13 receives analog and digital input signals from sensors 12 and in response provides control signals to control mechanisms 11. ECU develops these control signals based on a set of predefined relationships that are stored therein. According to one embodiment, ECU 13 communicates with user controller 14.

User controller 14 communicates with and is operative to reprogram ECU 13. According to one embodiment, user controller 14 comprises a personal computer that communicates with ECU through a standard modem. According to one specific embodiment, user controller 14 comprises a laptop computer including a display screen to view engine control relationships (for example, tables of control variables) and a keyboard and mouse that is used to modify those control relationships.

Figure 2:
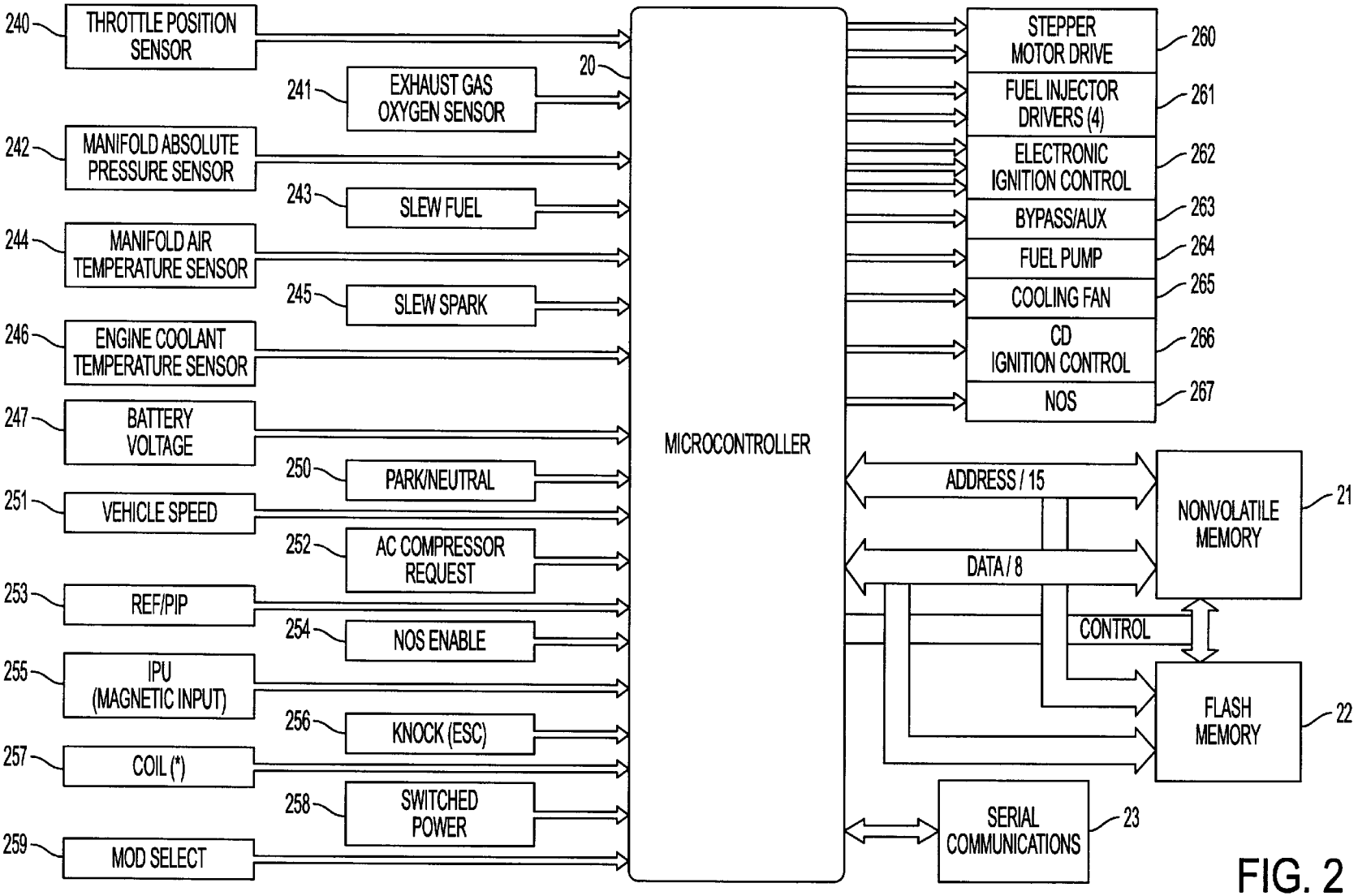
FIG. 2 is a schematic block diagram of an engine control unit according to one embodiment of the present invention.

FIG. 2 depicts ECU 13 in more detail. ECU 13 comprises micro-controller 20, nonvolatile memory 21, flash memory 22, and serial communications port 23. ECU 23 is responsive to a number of sensors that produce analog inputs and a number of digital inputs.

The analog inputs include inputs from throttle position sensor 240 (indicates the degree of rotation of the engine throttle under control of the operator), exhaust gas oxygen sensor 241 (positioned in the engine exhaust and is used to determine the richness and leanness of the air/fuel mixture entering the cylinders), manifold absolute pressure sensor 242 (indicates air pressure within the engine air intake manifold, which is indicative of engine load), slew fuel input 243 (enables rapid user control of the fuel supply to determine what effect more/less fuel has on engine operation at a given load/RPM point), manifold air temperature sensor 244, slew spark input 245 (enables rapid user control of the spark timing to determine what effect more/less spark has on engine operation at a given load/RPM point), engine coolant temperature sensor 246 and battery voltage input 247 (reduced voltage input to micro-controller 20 that is indicative of battery voltage —e.g. a 4.8 V input represents 16 V at the battery). Each of these sensors may comprise appropriate conventional sensors.

The digital inputs include a park/neutral signal 250 (indicates current drive status of vehicle to prevent engine from being started in gear), vehicle speed signal 251 (determines vehicle speed based on drive shaft rotation), ac compressor request signal 252 (indicates ac compressor is on and therefore engine load has increased), REF/PIP signal 253 (signal from OE distributor module indicates spark reference and provides system trigger for GMs and Fords respectively), NOS enable signal 254 (indicates the Nitrous oxide enrichment has been selected), IPU input 255 (magnetic input to be used as a spark reference for crank trigger wheel configurations), knock input 256 (output from a knock sensor), coil input 257 (input from ignition coil primary used as an alternate system trigger to REF/PIP and IPU), switched power input 258 (input indicating that the key to the engine has been turned on) and mode select input 259 (signal indicating whether micro-controller 20 should operate in normal mode or programmed mode).

In response to these analog and digital inputs, ECU 13 produces a number of control signals. Specifically, ECU 13 produces a stepper motor driver signal 260 (used to control the idle air stepper motor (IAC) coupled to the manifold air bypass of engine for adjusting idle speed); fuel injector driver signals 261 (pulsed signals of controlled time duration used to control a plurality of fuel injectors for injecting desired quantities of fuel to the air manifold adjacent to the cylinder intake ports of the engine); electronic ignition control signal 262 (used to control spark timing of the engine); bypass/aux control signal 263 (in aux mode may be used, e.g., for controlling a plurality of LEDs on an operator console or panel to indicate any fault or warning conditions to the operator; in bypass mode may be used to control the function of certain ignition modules, e.g., GM ignition modules); fuel pump control signal 264 (used to control a fuel pump to feed fuel from a tank or supply (not shown) to the injectors of engine); cooling fan control signal 265 (used to control a fan to cool fluid in the radiator based on engine temperature); CD ignition control signal 266 (used to control firing of an after-market CD and thus timing of the engine) and NOS control signal 267 (used to control a solenoid used to provide NOS injection).

Microcontroller 20 receives the various analog inputs (240–247) and digital inputs (250–259) and generates the control signals (260–267) using control relationships stored in nonvolatile memory 21. According to one embodiment, microcontroller 20 comprises any suitable microprocessor based controller. According to one specific embodiment, microcontroller 20 comprises a Motorola HC68HC11 microprocessor. Other microprocessors are possible.

According to one embodiment, the present invention comprises two separate memories. Nonvolatile memory 21 is used to store the control relationships that are used to develop control signals in conjunction with the various analog and digital inputs. Flash memory 22 is used to store the executable code for microcontroller 20.

Nonvolatile memory 21 employs a two tier memory structure that comprises a working storage area and a non-volatile storage area. The working storage area comprises a read/write memory that is used to store the control relationships during engine operation. According to one embodiment, the working storage area comprises memory that can be written and rewritten in real-time so that control operation is not interrupted even while the control relationships are being modified. According to one embodiment, working storage area comprises RAM. The non-volatile storage area comprises memory that stores the control relationships when power is lost to microcontroller 20. According to one embodiment, the non-volatile storage area comprises EEPROM. In one particular embodiment, both working storage area and non-volatile storage area comprise a single non-volatile static RAM chip. Such a chip comprises both RAM and a backup non-volatile EEPROM for storing information when power is lost.

Flash memory 22 comprises a memory that is used to store the executable code for microcontroller 20. As discussed above, in conventional microcontrollers it was not possible to rewrite the executable code. Rather, the memory holding the executable code, typically some type of ROM, had to be swapped with a memory having the new executable code "burned in." In contrast, flash memory 22 comprises a writeable, non-volatile memory. According to one embodiment, flash memory 22 comprises a flash EPROM. Thus, executable code for the microcontroller can be rewritten as necessary.

Serial communications port 23 enables microcontroller 20 to communicate with other devices. According to one embodiment, user controller 14 communicates with microcontroller 20 through serial communications port 23. Thus, serial communications port 23 is the communications port through which the control relationships and executable code for microcontroller 20 are rewritten. According to one embodiment, serial communications port 23 enables communication of microcontroller 20 with a remote device through a modem. According to one specific embodiment, serial communications port 23 comprises an RS232 communications port.

Figure 3:
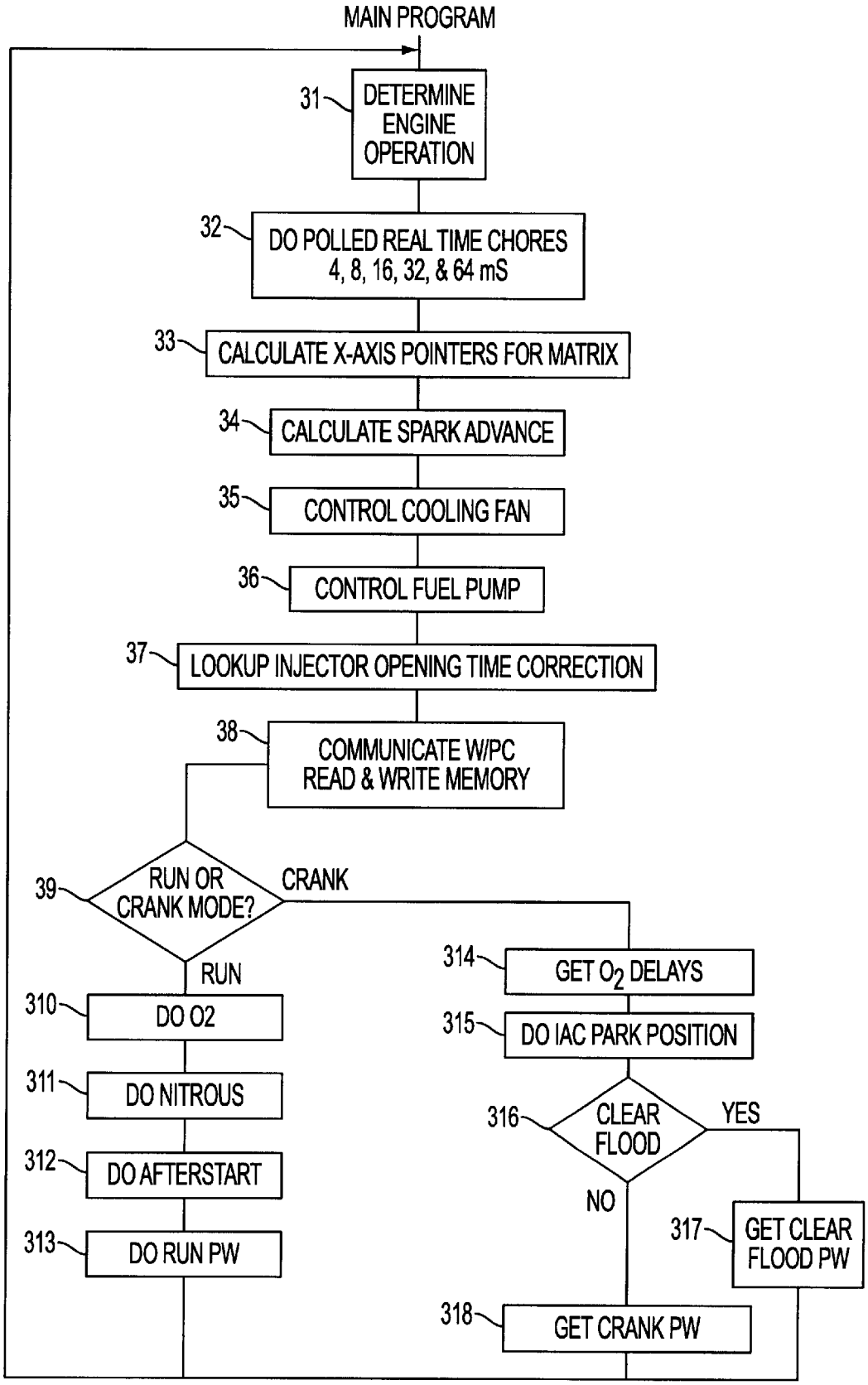
FIG. 3 is a flow chart of a method for controlling an engine according to one embodiment of the present invention.
Figure 4:
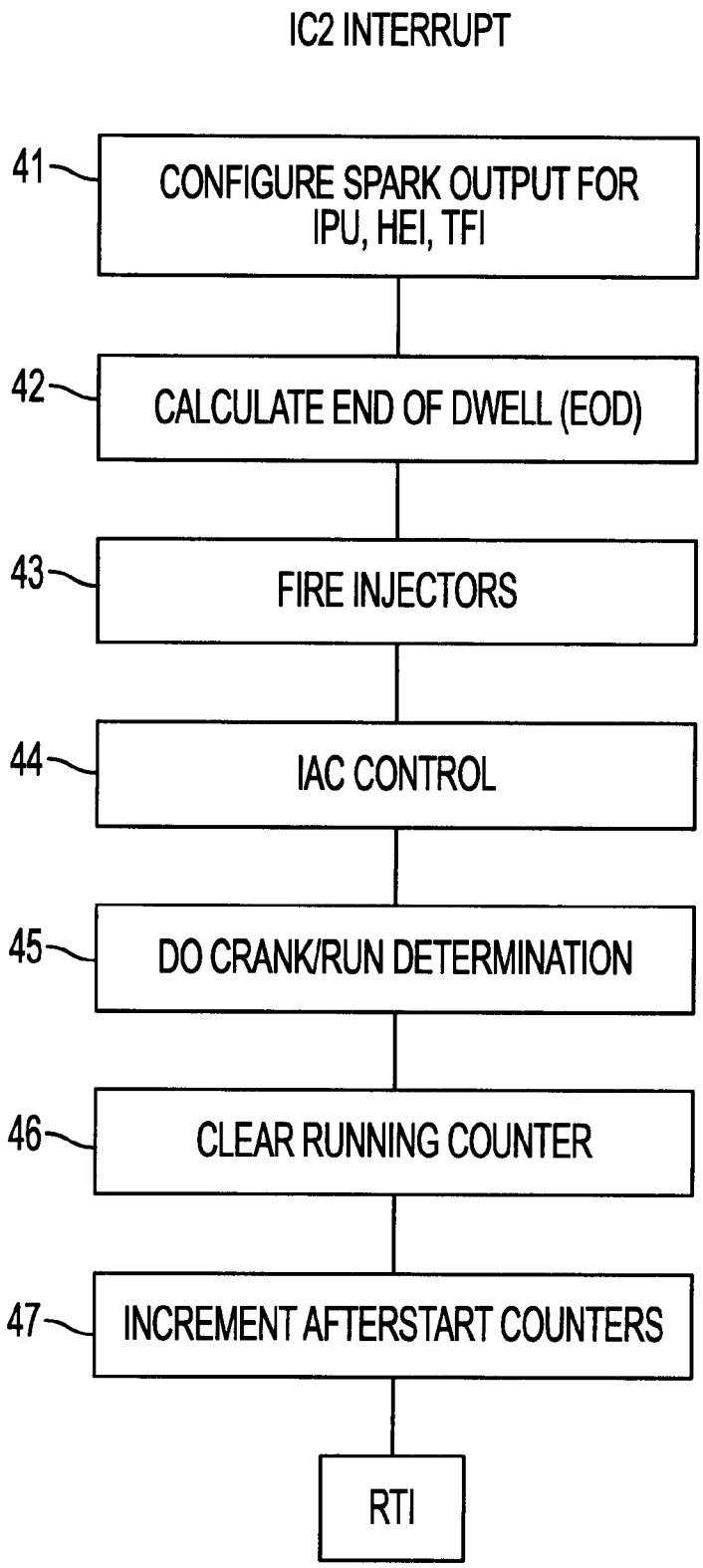
FIG. 4 is a flow chart of an input capture routine according to one embodiment of the present invention.
Figure 5:
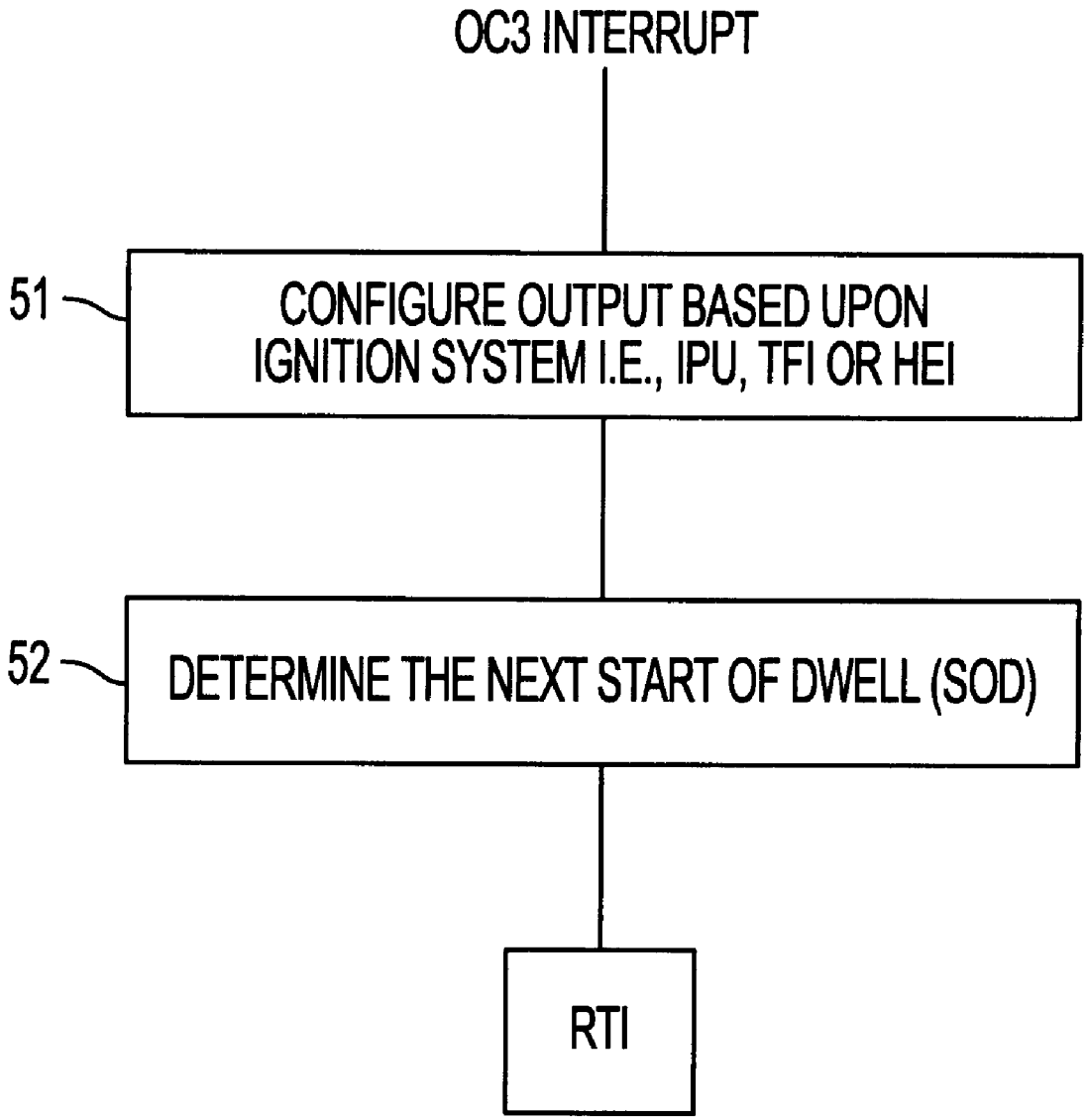
FIG. 5 is a flow chart of an output compare routine according to one embodiment of the present invention.

FIGS. 3, 4, and 5 depict flowcharts showing a method of controlling an engine according to one embodiment of the present invention. According to one embodiment, the method of controlling an engine comprises one or more computer programs that control an engine control unit such as ECU 13 and specifically microcontroller 20. FIG. 3 is a flowchart of the main program, FIG. 4 is a flowchart for an input capture routine, and FIG. 5 is a flowchart for an output compare routine. Each of FIGS. 3, 4 and 5 are explained in detail below.

The method of FIG. 3 begins in step 31 by monitoring ECU 13 to determine if the ECU is operating properly. The method comprises a safety mechanism that will reset the ECU (and the engine) if it is not operating properly. According to one embodiment, the safety mechanism comprises a software module that determines whether or not a set of instructions has been received. If the set of instructions has been received, it is determined that the ECU is operating properly and there is no need to shut the engine down. If the instructions are not received, it is determined that the engine is not operating properly and the ECU is reset and the engine is shut down.

In step 32, the method accomplishes a number of polled real-time chores. The polled real time chores comprise a set of operations that are accomplished at regular intervals. According to one embodiment, the program depicted in FIG. 3 comprises real-time chores that are accomplished at 4, 8, 16, 32, and 64 ms. Other intervals are possible. According to one embodiment, the polled real-time chores at each interval comprise separate subroutines. According to one embodiment, the following chores comprise real-time polled chores. Other chores may be added. Moreover, the chores outlined below may also be moved into any of the other routines, e.g., the main program or the routines of FIGS. 4 and 5. According to one embodiment, readings from throttle position sensor 240, exhaust gas oxygen sensor 241, manifold absolute pressure sensor 242, slew fuel sensor 243, manifold air temperature sensor 244, slew spark sensor 245, engine coolant temperature sensor 246 and battery voltage sensor 247 are checked, and their values are converted from analog values to digital values in real-time at step 32.

The running counter comprises a counter that is used to determine whether or not the engine being controlled is operating properly. The running counter is monitored and incremented during the regular intervals in the main program and cleared during the input capture routine (explained in conjunction with FIG. 4 below). Therefore, if the running counter rises above a particular value it provides an indication that the input capture routine (that is initiated based on crankshaft rotation) has not been initiated and accordingly, that the engine has stopped. According to one embodiment, the running counter comprises a software module that is monitored and incremented at regular intervals. According to this embodiment, if the running counter has reached a value of 128, it is an indication that the engine is not running properly, and engine control unit 13 is reset.

According to another embodiment, the idle air control IAC) stepper motor is adjusted as one of the real-time chores. The IAC stepper motor 260 is part of a PID control loop (see step 44 of FIG. 4) that maintains engine idle speed at a programmed RPM level. Specifically, engine speed and the rate and direction of change of engine speed are monitored and adjustments to IAC stepper motor position are made to either increase or decrease bypass air flow to and thus to increase or decrease engine idle speed, respectively.

According to another embodiment, the rate of change of throttle position is calculated as one of the real-time chores. The rate of change in throttle position is used to determine whether or not transient fueling is necessary. In a simultaneous double-fire engine fuel delivery system, fuel is delivered once per crankshaft revolution. Injector pulses are synchronous with the trigger input from the engine tachometer. If the throttle is opened abruptly, synchronous fuel delivery is typically insufficient, and the engine may hesitate or backfire. To overcome this problem, additional fuel pulses are delivered between the synchronous pulses. This is termed asynchronous fueling in the art because the additional fuel is not synchronized with the tachometer signal. When the engine is cold, transient response is greatly improved by the addition of asynchronous fuel, while at hotter engine temperatures asynchronous fuel tends to over fuel the engine. According to one embodiment, a defined relationship between the rate of change of throttle position and engine coolant temperature is used to determine whether or not asynchronous fueling is appropriate.

According to another embodiment, the rate of change of manifold pressure is a real-time chore and is used to determine whether or not transient fueling is required. According to one embodiment, similar to explained above, a defined relationship between the rate of change of manifold pressure and engine coolant temperature is used to determine whether or not synchronous fueling is appropriate.

According to another embodiment, the knock signal 256 is also monitored. As shown in FIG. 2, the knock sensor comprises a separate digital input to the ECU. According to one embodiment, each time a knock is detected, a programed amount of timing is removed.

According to another embodiment, a number of control parameters are looked up as real-time chores. According to one embodiment, these control parameters are based on the current operating conditions of the engine. One example of a control parameter that is looked up as a part of the real-time chores is the park position for the IAC stepper motor.

Returning to FIG. 3, in step 33, x-axis pointers are calculated for the control matrices. According to one embodiment, defined relationships are used in conjunction with sensor readings to control engine performance. For example, in conjunction with the system shown in FIGS. 1 and 2, for every possible reading of manifold absolute pressure sensor 244 and vehicle speed sensor 251, microcontroller 20 provides a particular control signal to fuel injector drivers 261. The same is true for the other sensors and control mechanisms shown in FIG. 2. These relationships between the sensor readings and the control signals can be expressed in a number of different ways including in a matrix of numbers, and in a graph. In either case, it may be desirable to view the relationship in more detail in a particular area. Therefore, in step 33, x-axis pointers for the relationship may be set. Thus, if one area of the relationship is of particular interest, a user may set several pointers in that area, effectively giving more resolution to the relationship within that area. According to one embodiment, x-axis pointers may be set for each control relationship. According to another embodiment, x-axis pointers may be set for the fuel map (used to control fuel injector drivers 261) and the spark map (used to control electronic ignition controller 262).

In step 34, the spark advance is calculated. According to one embodiment, the spark advance is calculated using a defined relationship (as explained above) based on the RPM reading from vehicle speed sensor 251 and a load reading. The load reading may comprise either a reading from manifold absolute pressure sensor 242, or throttle position sensor 240. These two factors, determine a spark advance from the defined relationship.

In step 35, cooling fan 265 is controlled. According to one embodiment, cooling fan 265 is controlled using a defined relationship based on present readings from engine temperature sensor 246. According to one embodiment, if the engine temperature is greater than a certain threshold, the cooling fan is activated.

In step 36, fuel pump 264 is controlled. According to one embodiment, fuel pump 264 remains on, as long as the engine is cranking. According to a specific embodiment, the running counter (as explained above) is monitored to determine whether or not the engine is cranking. If the running counter is less than a predetermined number, the engine is cranking, and the fuel pump remains activated. According to another embodiment, if the engine continues to crank for more than some predetermined amount of time, the fuel pump is turned off. According to a specific embodiment, if the engine continues to crank for more than 10 seconds, the fuel pump is turned off.

In step 37, the injector opening time is corrected based on a defined relationship. The opening time for fuel injectors may vary based on the battery voltage. Therefore, in step 37, the injector opening time is controlled based on the battery voltage. As explained above, the present invention uses a number of defined relationships in conjunction with sensor readings to control engine performance. In the case of the injector opening time, according to one embodiment, the battery voltage is determined from battery voltage sensor 247, and the particular injector opening time that is appropriate for that battery voltage is determined in step 37 and used to control fuel injector drivers 261. According to another embodiment, a correction factor for injector opening time is determined based on the battery voltage and used to control fuel injector drivers 261.

In step 38, an engine control unit communicates with a programmer to adjust engine control relationships. According to one embodiment, the method of FIG. 3 operates in conjunction with ECU 13 shown in FIGS. 1 and 2. In this embodiment, when user controller 14 communicates with ECU 13, control parameters are read from and written to non-volatile static memory 22. According to one particular embodiment, data is moved in and out of memory 22 in blocks. Thus, if a user desires to adjust the responsiveness of the engine to a change in manifold absolute pressure, the entire fuel map may be pulled from memory 22 and sent to user controller 14 through RS232 communication port 23. A user can then view the map at user controller and make appropriate adjustments.

In step 39, a determination is made whether the engine is running in crank mode or run mode. Depending on whether the engine is operating in run or crank mode, a different set of operations is accomplished. According to one embodiment, it is determined that the engine is operating in run mode if it has been operating at greater than 350 rpm for a predetermined number of cycles. According to a specific embodiment, the reading from engine speed sensor 251 is used to determine whether the engine is operating in run or crank mode. If in step 39, it is determined that the engine is operating in run mode, operations 310 to 313 are accomplished. If in step 39 it is determined that the engine is operating in crank mode, operations 314 to 318 are accomplished.

In step 310, the $O_2$ subroutine is accomplished. In the $O_2$ subroutine, the $O_2$ sensor is checked to determine whether or not the air fuel mixture needs adjustment. According to one embodiment, if air fuel mixture needs to be adjusted, a PI control loop is used to make the necessary adjustments based on a defined relationship between engine speed and load. Such adjustments are known in the art.

In step 311, the nitrous oxide subroutine is called. The nitrous oxide subroutine monitors the nitrous enable line 254 shown in FIG. 2, to determine whether or not nitrous oxide is to be added to the fuel mixture. If the status of nitrous enable line 254 indicates the nitrous oxide is to be added to the fuel mixture, and minimum throttle position, time and RPM thresholds have been met, it is determined that it is appropriate to add nitrous. If nitrous is added, appropriate adjustments to fuel and timing are made based on the RPM reading of vehicle speed sensor 251 and a defined relationship.

In step 312, after start subroutine is accomplished. After start enrichment is intended to help overcome the initial start-up frictions and viscosities present in a cold engine, as well as to compensate for hot soak fuel vaporization in the fuel system of hot engines. The after start subroutine is used to add additional fuel to the engine in the time period following ignition. According to one embodiment, a counter is maintained to determine whether or not after start enrichment is appropriate. The after start counter is incremented in the input capture subroutine shown in FIG. 4 and thus provides an indication of the number of crankshaft revolutions that have occurred. According to one embodiment, if the after start enrichment is appropriate, an appropriate amount of fuel to be added is determined based on a reading of engine speed sensor 251 and a defined relationship. The additional fuel to be added is gradually decayed based on a defined relationship between the engine coolant temperature and the counter.

In step 313, the fuel injector pulse width subroutine is accomplished. Based on a defined relationship between the manifold absolute pressure and engine speed, the fuel injector pulse width is adjusted. According to one embodiment, a look up table is used to store fuel injector pulse width. According to one specific embodiment, manifold absolute pressure sensor 244 and vehicle speed sensor 251 are read and used to determine the appropriate fuel injector pulse width under run conditions.

If it is determined that the engine is operating in crank mode in step 39, then, in step 314 an $O_2$ delay is determined. According to one embodiment, the $O_2$ delay is determined based on initial coolant temperature and a defined relationship. As explained previously, the present invention uses a number of defined relationships in conjunction with sensor readings to control engine performance. According to one embodiment, $O_2$ delay is determined based on readings from engine coolant temperature sensor 246.

In step 315, the park position for IAC stepper motor is determined. According to one embodiment, the park position is determined based on initial coolant temperature and a defined relationship. As explained previously, the present invention uses a number of defined relationships in conjunction with sensor readings to control engine performance. In the case of the park position, according to one embodiment, the park position is determined based on readings from engine coolant temperature sensor 246.

In step 316, it is determined whether or not a flood has occurred. If a flood has occurred in step 317, injector pulsing is stopped. According to one embodiment, readings from throttle position sensor 240 are used to determine whether or not a flood has occurred. If throttle position exceeds a certain threshold, it is determined a flood has occurred and a clear flood mode is initiated. In the clear flood mode, among other things, injector pulsing is stopped.

If it is determined that no flood has occurred, in step 318, the crank pulse width for the fuel injector is determined. According to one embodiment, the crank pulse width for the fuel injectors is determined based on a predefined relationship with engine coolant temperature. According to one embodiment, a look up table is used to store fuel injector pulse width under cranking conditions. According to one specific embodiment, engine coolant temperature sensor 246 is read and used to determine the appropriate fuel injector pulse width.

After either the run time or crank time chores have been accomplished, the operation of the main program returns to step 31.

FIG. 4 is a flow chart showing a method of capturing input for a subroutine of the main program for controlling ECU 13 shown in FIGS. 1 and 2. The input capture method shown in FIG. 4 is initiated based on crankshaft rotation. According to one embodiment, the method of FIG. 4 is initiated after the crankshaft rotates 90°. Other embodiments are possible.

The input capture method of FIG. 4 begins with Step 41 where the spark output configuration is determined. The spark output configuration depends on the type of engine that is being controlled. The engine control unit shown in FIG. 2 may be used to control a number of different engines. According to one embodiment, ECU 13 is used to control an engine with an inductive pickup ignition. According to other embodiments, ECU 13 is used to control other engine types.

In step 42 the end of dwell (EOD) is calculated. The end of dwell is calculated in a manner that is known in the art. According to one embodiment, the start of dwell (SOD) is calculated in the output interrupt subroutine shown in FIG. 5.

In step 43 the injectors are fired. According to one embodiment, the manner in which the injectors are fired depends on, at least, the mode of operation of ECU 13 and the number of cylinders. According to one embodiment, the ECU may operate in conjunction with a port fuel injection system or a throttle body fuel injection system and in conjunction with engines having any number of cylinders. Thus, depending on these two factors, a different set of signals are generated by microcontroller 20 and are used to control fuel injector drivers 261.

In step 44, idle air stepper motor is controlled. The IAC stepper motor is used to control the amount of air in the fuel air mixture and thus control the idle speed. According to one embodiment, a PID (proportional integral differential) calculation is used to determine the IAC control. According to one embodiment, the PID calculation is based on the difference between the desired and actual idle speed (as measured by vehicle speed sensor 251).

In Step 45 the determination is made as to whether the engine is operating in crank mode or run mode. According to one embodiment, if the engine is operating at greater than 350 RPMs for more than a predetermined number of cycles, the engine is operating in run mode. Otherwise, it is determined that the engine is operating in crank mode.

In Step 46 the running counter is cleared. As explained above, the running counter holds a count that is used to determine whether the engine and the ECU are operating properly. Operation of the input capture subroutine indicates that the engine and the ECU are operating properly. Thus, in step 46 the running counter is cleared. As explained above, according to one embodiment, the running counter comprises a software module that is incremented every four milliseconds.

In Step 47 the after start counter is incremented. The after start counters are used to determine whether or not the engine is operating in an after start mode. For a period of time after an engine is started a richer fuel air mixture is used. The after start counter begins at zero and is incremented each time through the input capture subroutine. When the input counter reaches a certain threshold, it is determined that the richer fuel air mixture is no longer necessary. That is, the engine is no longer operating in an after start mode.

FIG. 5 shows a flowchart depicting an output compare subroutine. The output compare subroutine is initiated after each input capture subroutine. Other embodiments are possible. According to one embodiment the input capture subroutine shown in FIG. 4 is used to develop inputs that are used in the output compare subroutine of FIG. 5.

The output compare subroutine shown in FIG. 5 begins at step 51 by determining the type of ignition system that is being used. As explained in conjunction with FIG. 4, step 41, the ECU may be used in conjunction with a number of different engine configurations and ignition systems. Each different configuration generally requires a different form of output. Thus, in Step 51 the output is configured for the proper ignition system. According to one embodiment the ECU is used in conjunction with an inductive pickup ignition system.

In Step 52 the start of dwell (SOD) is determined. The start of dwell is determined using the inputs developed in the input capture subroutine shown in FIG. 4. The start of dwell is determined in a manner that is known in the art.

Figure 6:
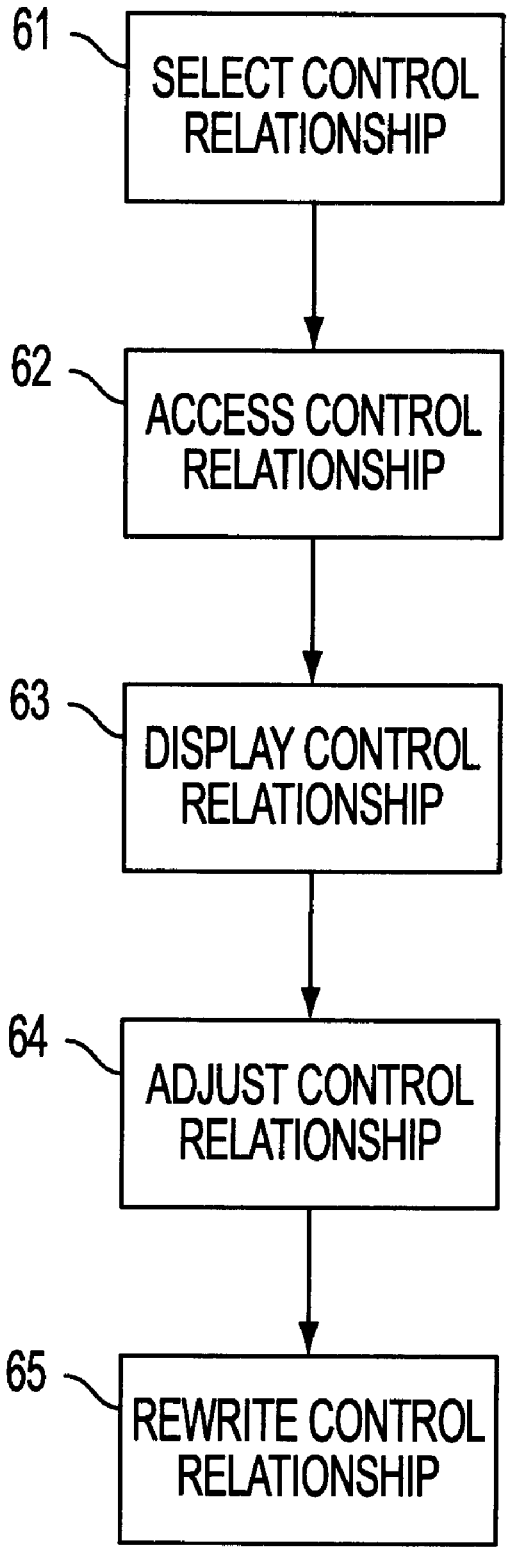
FIG. 6 is a flow chart of a method for adjusting an engine control relationship according to one embodiment of the present invention.

FIG. 6 is a flowchart showing a method for adjusting engine control relationships according to another embodiment of the present invention. According to one embodiment, the engine control relationships are adjusted by a user through a personal computer. The method will be explained in conjunction with the method and system shown in FIGS. 1–5. In that system, as explained above, user controller 14 is provided to accomplish modification of the control relationships.

Before the method begins, a number of engine parameters are set. The method and system of the present invention is useful in conjunction with a number of different engine types that have different specifications. According to one embodiment, these specifications such as the number of cylinders, and whether the engine uses throttle body fuel injection or port fuel injection are selected before control begins.

The method begins in step 61 with selection of a control parameter for adjustment. According to one embodiment, a user may select any of a plurality of control relationships for adjustment. These control relationships are generally known in the art and are explained briefly below.

The fuel relationship controls the injector pulse width under run conditions based on manifold absolute pressure and engine speed. According to one embodiment, this relationship is utilized at step 313 of the control method shown in FIG. 3.

The spark relationship controls the spark timing based on engine speed and engine load. Engine load may be measured by manifold absolute pressure or by throttle position. According to one embodiment, the spark relationship is utilized at step 34.

At least two relationships are used to control the idle that may be chosen in step 62. The idle speed relationship controls the speed of the idle through control of IAC stepper motor and depends on engine coolant temperature. According to one embodiment, the idle speed relationship is utilized in step 44 of FIG. 4. The idle park position relationship controls the position in which the idle is parked and depends on engine coolant temperature. According to one embodiment, the idle park position relationship is utilized in step 315 of FIG. 3.

The throttle follower relationship allows a user to monitor the throttle position and idle bypass air of the engine, and to set the minimum limit of the bypass air. The purpose of the throttle follower relationship is to back the idle control mechanism away from its stop at the fully closed position, thereby leaking more air into the intake manifold at off-idle speeds to keep it from smothering the engine during rapid deceleration.

A number of acceleration enrichment relationships control whether or not additional fuel should be added during acceleration condition. According to one embodiment, acceleration enrichment is expressed as additional pulse width to be added to both synchronous or asynchronous pulse widths resulting from the base fuel relationship. Acceleration enrichment relationships depend on: 1) the rate of change of the throttle position; 2) coolant temperature; 3) the throttle position 4) the rate of change of manifold absolute pressure, 5) a decay rate factor and 6) manifold pressure acceleration compensation as a function of coolant temperature.

The after start enrichment relationship controls the amount of after start fuel to be added to the engine and depends on coolant temperature. The after start enrichment relationship relates percent enrichment to engine coolant temperature. The enrichment percentage is added to the base pulse width from the base fuel map. The after start hold off relationship controls when after start enrichment should begin and depends on the number of engine revolutions (as measured using, e.g., an after start counter) and engine coolant temperature. The amount of enrichment decays at a rate specified in an after start enrichment decay relationship. The after start enrichment decay relationship controls the rate at which fuel enrichment is to be diminished and depends on engine coolant temperature and the number of revolutions that have occurred. According to one embodiment, the after start relationships are utilized in step 312 of FIG. 3.

The warm-up enrichment relationship controls whether or not fuel is to be added synchronously while the engine is warming up and depends on engine coolant temperature. The relationship determines an enrichment factor that increases the fuel delivered to the engine during warm-up based on engine coolant temperature.

The air temperature enrichment relationship controls whether or not fuel is to be added synchronously and depends on air temperature into the engine. According to one embodiment, the reading of manifold air temperature sensor 244 is utilized to determine whether or not air temperature enrichment is appropriate.

The cranking pulse width relationship controls the fuel injector pulse width under cranking conditions. The injector pulse width under cranking conditions depends on engine coolant temperature. According to one embodiment, this relationship is utilized at step 318 of the control method shown in FIG. 3.

Figure 7:
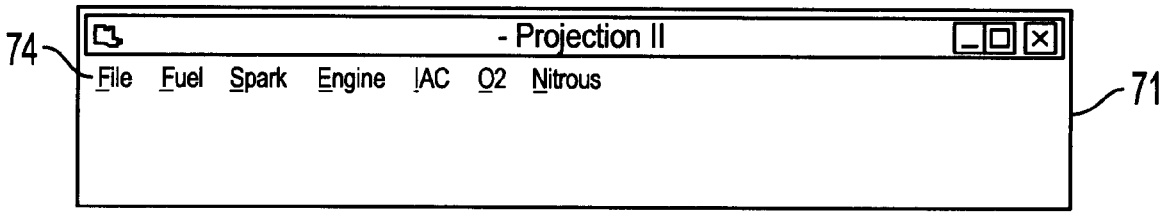
FIG. 7 shows an exemplary graphical user interface used to select a control relationship in conjunction with the method of FIG. 6.

According to one embodiment, a graphical user interface (GUI) is provided to enable the user to select a particular control relationship to modify. The GUI may provide any of a number of known mechanisms such as text boxes and dialog boxes to enable a user to select or enter a particular control relationship to be adjusted. An exemplary GUI that may be used to select a control relationship to modify is shown in FIG. 7. FIG. 7 depicts a selection GUI 71. Selection GUI 71 comprises a number of pull down menus 74 that may be used to select various ones of the control relationships for displaying and adjusting.

In step 62, the control relationship is accessed. According to one embodiment, the method for adjusting the control relationship operates in conjunction with the system of FIGS. 1 and 2 and user controller 14 communicates with engine control unit 13, using a modem and serial communication port 23, to access the selected control relationship. According to this embodiment, control relationships are stored in nonvolatile static memory 21. As explained above, nonvolatile static memory 21 advantageously enables transfer of data in and out in blocks such that the control relationship may be quickly downloaded to user controller 14 over a modem.

In step 63, the control relationship is displayed to the user. The control relationships vary in complexity. Some, such as the fuel relationship comprise a look-up table that is addressed using the appropriate parameters (manifold absolute pressure and engine speed in the case of the fuel relationship). According to another embodiment, a two-dimensional look-up table may be depicted as a three dimensional map. Other control relationships may comprise a one dimensional relationship or a single value. According to one embodiment, user controller 14 is used to display the control relationship as a table and/or a graph and/or a parameter as appropriate.

Figure 8:
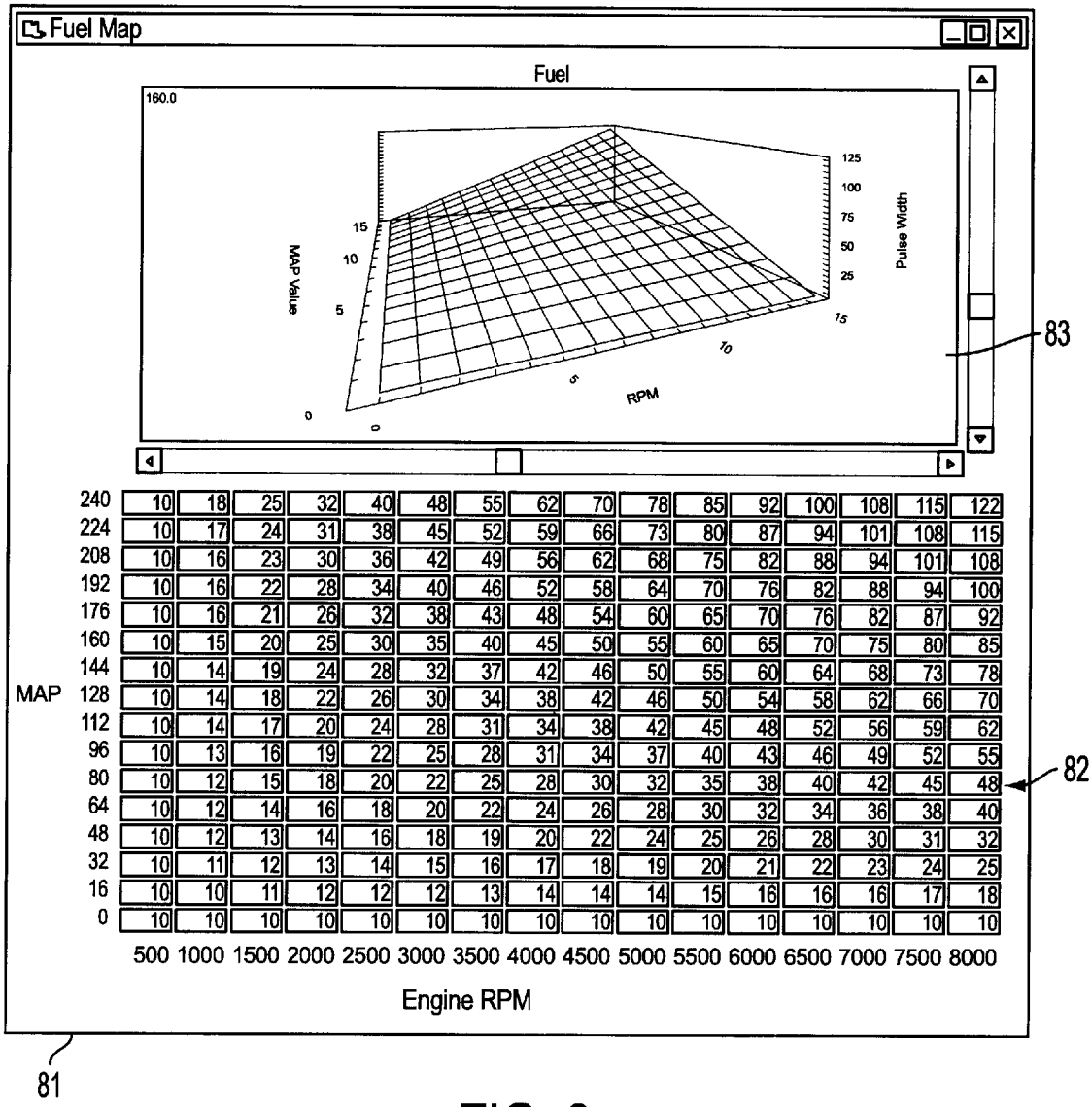
FIG. 8 shows an exemplary graphical user interface used to display and adjust the fuel map.
Figure 9:
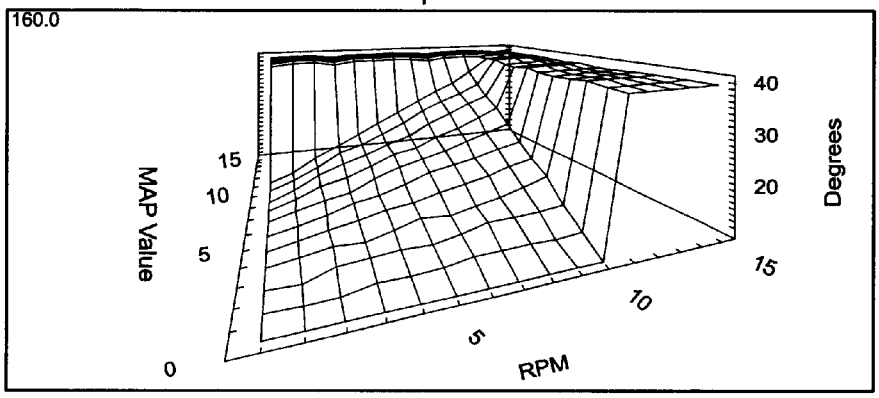
FIG. 9 shows an exemplary graphical user interface used to display and adjust the spark table.
Figure 11:
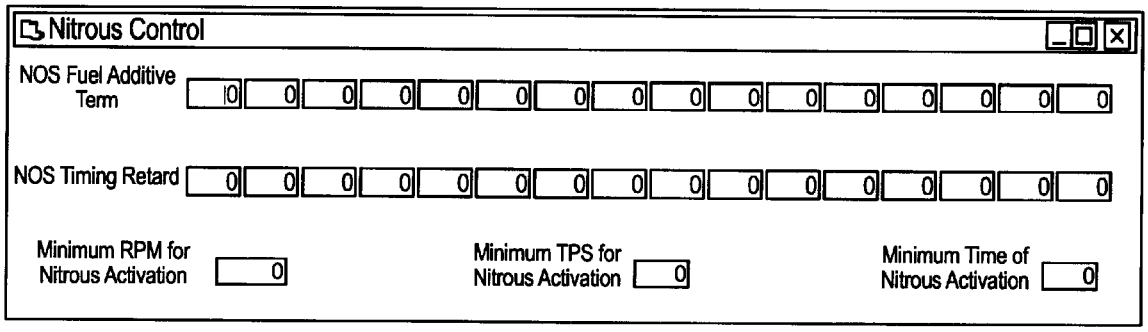
FIG. 11 shows an exemplary graphical user interface used to display and adjust the nitrous oxide control relationship.

One example of the display of a fuel relationship is shown in FIG. 8. FIG. 8 shows the fuel relationship 81 as a matrix or map of numbers 82. This fuel map display comprises a display window having a matrix of numeric parameters that form the ECU's base fuel map. The rows correspond to manifold absolute pressure and the columns to engine speed in RPM.

Figure 13:
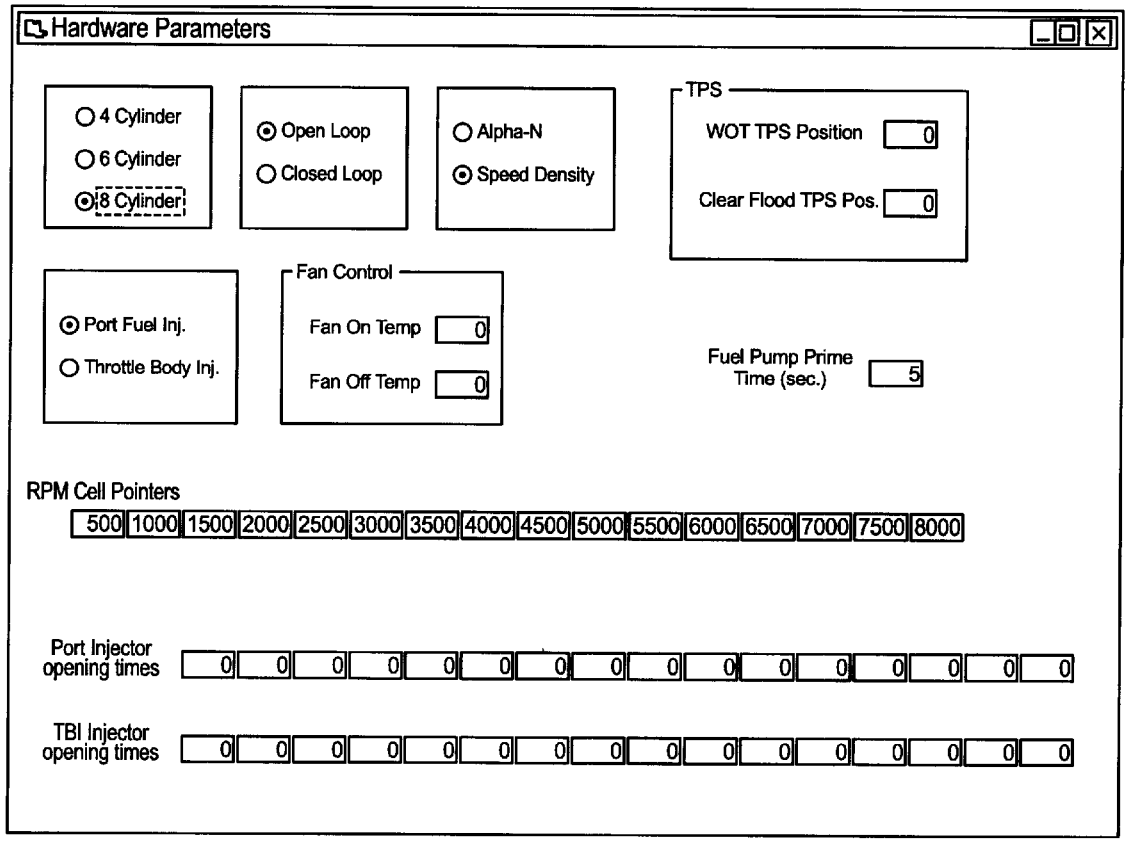
FIG. 13 shows an exemplary graphical user interface used to display and adjust various hardware parameters.

FIG. 8 also shows the fuel relationship as a three dimensional graph 83. The three dimensional plot of the base fuel map is useful for identifying severe discontinuities or irregularities in the base fuel map that may otherwise go unnoticed in the numeric table. The display of other relationships is similar to the display of the fuel relationship. FIGS. 9–13 show GUIs that are used to control other exemplary relationships such as the spark table (FIG. 9), IAC (FIG. 10), nitrous oxide boost (FIG. 11), closed loop parameters (FIG. 12), and hardware parameters (FIG. 13).

In step 64, the selected control relationship is adjusted. According to one embodiment, for use in conjunction with the display of the relationship as a map, a mouse is used to select one of the values in the map in a manner that is known in the art. Once the value is selected, the up and down arrow keys on a keyboard may be used to adjust the value. Alternatively, the user may simply type a new value over the existing value. According to another embodiment, for use in conjunction with the display of the relationship as a graph, a mouse is used to select and hold a point on the graph. Once selected the point on the graph may be physically raised or lowered using the mouse. Alternatively, once the point on the map is selected, the up and down arrow keys on a keyboard may be used to adjust the value. Other methods of adjusting a value are possible.

In steps 65, the adjustments are rewritten to memory in the controller and are available for use by the controller in real-time. According to one embodiment, when a user uses the mouse or keyboard arrows to adjust a control relationship, that adjustment is immediately communicated to the engine control unit and written over the existing control relationship. Thus, those adjustments are advantageously made available for use by the controller in real-time without any control disabling in contrast to conventional control schemes. According to one embodiment, this is made possible by the provision of nonvolatile static memory 21 shown in FIG. 2. The end result is that the effect of the adjustments are felt in real time in the vehicle.

The invention has been described in connection with particular embodiments. These embodiments are intended to be illustrative only. It will be appreciated by those skilled in the art that modifications may be made to these preferred embodiments without departing from the scope of the invention as defined by the appended claims.

What is claimed is:

1. An engine control system for providing electronic control signals to an engine comprising:

one or more sensors for producing input signals in response to engine operating conditions;

one or more control apparatus responsive to the electronic control signals and operative to control engine operating conditions;

an electronic control unit operative to produce the electronic control signals in response to the input signals based on a set of defined relationships, and comprising a memory, the memory comprising:

a working storage area operative to store the set of defined relationships during operation of the electronic control unit, and a second storage area operative to store the set of defined relationships when the electronic control unit loses power;

a user controller permitting viewing and modifying the set of defined relationships;

wherein the electronic control unit and the user controller enable selective rewriting of the set of defined relationships in real-time without interrupting control operation.

2. The engine control system of claim 1 wherein the memory comprises a non-volatile static RAM.

3. The engine control system of claim 1 wherein the set of defined relationships comprises a set of look-up tables.

4. The engine control system of claim 1 wherein the electronic control unit further comprises a microcontroller responsive to the input signal.

5. The engine control system of claim 1 wherein the electronic control unit further comprises a flash memory for storing executable code for the electronic control unit.

6. The engine control system of claim 5 wherein the flash memory comprises memory that may be rewritten to change the executable code for the electronic control unit.

7. A method of controlling an engine comprising:

providing one or more input signals in response to engine operating conditions;

producing electronic control signals in response to the input signals based on a set of defined relationships;

selectively modifying the set of defined relationships in real-time without interrupting the production of electronic control signals;

storing the set of defined relationships in a working storage area of a memory unit during operation;

storing the set of defined relationships in a second storage area of the memory unit upon power loss;

wherein the electronic control signals are used by one or more control apparatus that are operative to control engine operating conditions.

8. The engine control method of claim 7 wherein the set of defined relationships comprises a set of look-up tables.

9. The engine control method of claim 7 wherein modifying the set of defined relationships comprises modifying one or more entries in the set of look-up tables.

10. The engine control method of claim 7 further comprising storing a log of modifications that are made to the set of defined relationships.

11. The engine control system of claim 7 wherein the memory unit comprises a non-volatile static RAM.

* * * * *